United States Patent [19]

King

[11] Patent Number: 4,496,295

[45] Date of Patent: Jan. 29, 1985

[54] PERISTALTIC PUMPS

[76] Inventor: Oswald M. King, 3321 Devon Cir., Huntington Harbor, Calif. 92649

[21] Appl. No.: 591,430

[22] Filed: Mar. 20, 1984

Related U.S. Application Data

[63] Continuation-in-part of Ser. No. 360,406, Mar. 22, 1982, abandoned.

[51] Int. Cl.[3] ..... F04B 43/12

[52] U.S. Cl. ..... 417/477

[58] Field of Search ..... 417/474–477; 138/118, DIG. 5, DIG. 8

[56] References Cited

U.S. PATENT DOCUMENTS

| | | | |
|---|---|---|---|
| 2,696,173 | 12/1954 | Jensen | 417/477 |
| 3,277,356 | 10/1966 | Kraft | 417/475 X |
| 3,397,646 | 8/1968 | Allsopp | 417/476 X |
| 4,187,057 | 2/1980 | Xanthopoulos | 417/477 X |

FOREIGN PATENT DOCUMENTS

| | | | |
|---|---|---|---|
| 193574 | 3/1923 | United Kingdom | 417/477 |

*Primary Examiner*—Richard E. Gluck

*Attorney, Agent, or Firm*—Grover A. Frater

[57] ABSTRACT

An improved peristaltic pump employs a pump tube which is pre-stressed by being twisted in the direction of the length of the tube about its axis.

10 Claims, 6 Drawing Figures

10
16
22
24
40
30
14
32
OUT
IN
20
12
38
40
18
26

38

38

12
30

40
60
16
62
34
52
58
54
36
42
44
56
50
32
22
24
18
20
30
64
68
70
38
40

PERISTALTIC PUMPS

CROSS-REFERENCE TO RELATED APPLICATION

This application is a continuation-in-part of application Ser. No. 360,406, filed Mar. 22, 1982, and now abandoned.

TECHNICAL FIELD

This invention relates to improvements in peristaltic pumps and in the elements of such pumps.

BACKGROUND ART

A peristaltic pump is one in which pumping is accomplished by pinching or squeezing the walls of a tube which contains material to be pumped such that the tube is collapsed shut at successive points along its length. In some forms, the pump tube is resilient, and in relaxed condition is maintained substantially cylindrical in cross-section by its renitence. When such a tube is used in the most common pump form, the form in which a cam presses the tube against a cylindrical inner wall, the tube becomes distorted. It tends to be stretched and twisted with each cam pass. The effect of that is twofold. The stretching reduces tube life, and the twisting causes the tubing to change its position in the pump housing, complicating housing design and increasing opportunity for malfunction.

Most peristaltic pumps employ more than one cam, usually in the form of rollers, which rotate around a fixed axis. The pump tube is flexible and usually is resilient. Its ends are fixed relative to the axis of cam rotation. The mid-region of the tube is extended around the cam set in the plane of cam set rotation. In some cases the tube is not forced against the wall of the pump cavity. Instead, the tube is stretched so tightly that it is pinched closed at the point engaged by the cam. In the region between the points of cam engagement, the tube lumen is open to accommodate fluid. In other cases the tube is housed in a circular, usually cylindrical, cavity, and the tube is pinched shut at the point of engagement by the cam because the cam presses the tube against the circular cavity wall. In either case the tube is formed into a partial loop, into hairpin or horseshoe shape. The inner circumference is less than the outer circumference. If the tubing was formed as a straight length it must twist along its length when bent to horseshoe shape to compensate for the difference in inner and outer circumference. When the resilient tubing is squeezed closed the ratio of circumferences is changed and the renitence of the tube wall urges a reduction in the degree of twist. If, on the other hand, the tube is formed in horseshoe shape, if it assumes that shape when relaxed, then squeezing it to reduce the difference between inside and outside circumferences will urge twisting in an opposite direction.

Thus it is that twisting is urged during pump operation whether the tubing be bent during installation or preformed to the shape it has when installed in a pump. It is true whether the tube is pinched by pressing it with the cam against a confining circular wall which encompasses the tube over its length, or whether the tube is pinched by the cam stretching the inner wall to meet the outer wall of the tube. The latter arrangement results in large forces tending to pull, then push, the ends of the tube in the direction of flow, and, partly for that reason, most peristaltic pumps include the encompassing wall.

Even in such pumps, the forces that are exerted on the structures that hold the tube ends in place are sufficiently large to shorten tube life and to influence the design of the entire pump structure.

The combined effect of the twisting and pulling of the pump tubing during pumping is to cause the tube to tend to move back and forth in the direction of the axis of cam rotation. In some cases that movement is sufficient to result in rubbing of the tubing against the end walls of the cavity in which the cam and tube are housed.

The invention provides a pump and pump tube in which these several problems are minimized.

DISCLOSURE OF THE INVENTION

An object of this invention is to provide improved peristaltic pumps, and to provide an improved resilient tube and the tube retention system for such pumps.

While the invention is particularly applicable to pumps which incorporate an encompassing wall against which the tube is squeezed, it is also applicable to pumps which rely on stretching to pinch off the tube.

One of the features of the invention is to hold the tube twisted about its longitudinal center line in the direction of its length against its renitence. That feature provides advantage beyond any afforded by molding the tube to final shape, and it avoids the expense of molding. In preferred form the tubing is one that has been formed in a curve having larger radius than what the radius will be when the tube is installed, and which lies in a flat plane when relaxed.

In the invention, the ends of the tubing are to be held fixed relative to the cam axis of the pump and the tube encompassing wall, and they are to be held such that the tube is twisted in the direction of its length. That is accomplished in preferred form by forming the tube ends with a conformation which extends radially relative to the tube axis, preferably radially outward, and which will interfit with and be prevented from rotation by a corresponding conformation in a portion of the valve housing or frame structure adjacent to the path of cam travel.

In preferred form, end fittings are bonded to the ends of the tubing. The fitting is shaped to form one element of a key and keyway, the other element of which forms part of the valve body or frame.

The pre-twisting of the tubing has the effect of biasing the tube so that, instead of occupying a flat plane, the tube is warped to lie in a curved plane. Passage of the cam roller over the inner surface of the tube will result in twisting of the tube in a direction to diminish the degree of pre-twist. The result is less movement out of that curved plane than would occur in the absence of pre-twisting. The pre-twisting utilizes the renitence of the tube to tend to hold it in warped condition.

The reduction in tube movement permits simplification in the design of the remainder of the pump. Strain on the end fittings and on the elements that hold them in fixed position is reduced. In the case of designs that include a cover over one side of the tube cavity, the tube is twisted to warp it away from the cover whereby need to bolt the cover in place is eliminated. One of the more important results of the stabilization of the tube is that intermittent operation is made more practical as a means for controlling flow rate, and the invention takes advantage of that fact.

DESCRIPTION OF THE PREFERRED EMBODIMENT

Figures 1, 2, 3, 4, 5, 6:
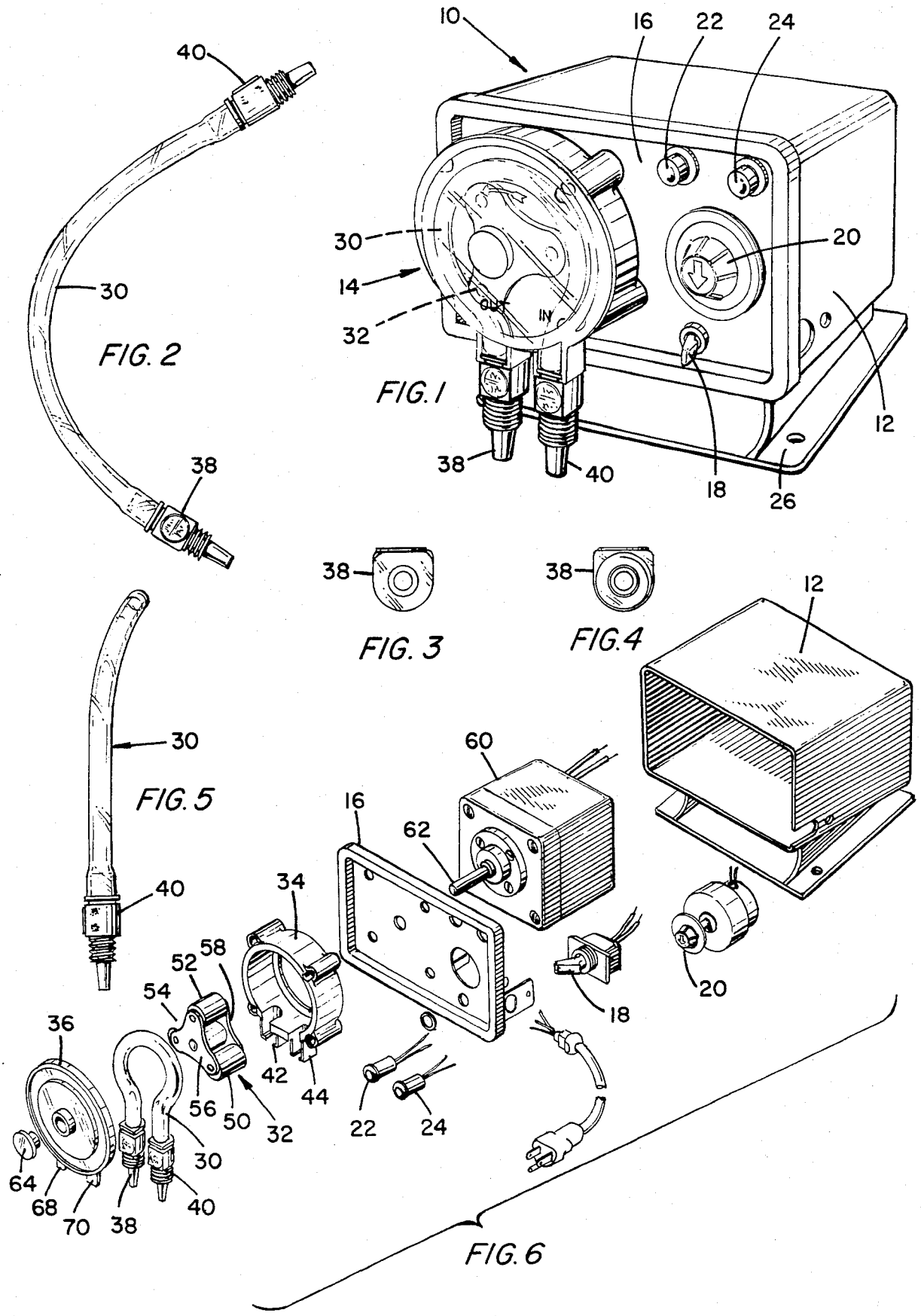
FIG. 1 is an isometric view of a pump in which the preferred form of the invention is embodied.
FIG. 2 is a top plan view of the preferred pump tube that is employed in the pump of FIG. 1 and shown here in relaxed condition.
FIGS. 3 and 4 are elevational views of the outlet one of the end fittings of the tube in FIG. 2 shown from the inlet end and outlet end of the fitting, respectively.
FIG. 5 is a side view of the tube of FIG. 2 shown as it appears when pre-stressed and installed in the pump of FIG. 1.
FIG. 6 is an exploded view of the elements that form the pump of FIG. 1.

The pump unit shown in FIG. 1 represents the preferred embodiment of the invention. It is suitable for chemical additive applications, food processing and dispensing, slurry feeding, photo-chemical processing, polymer injection, and a variety of other uses. The model shown is 18 cm deep, 14 cm high, and 16.5 cm wide. It is driven by an electric motor at a selected one of rotor speeds 15, 30 or 45 RPM. It can drive 1.3 mm wall thickness food grade vinyl pump tubing in a selected one of outside diameters of 6 or 9 mm. Those speed and tubing size choices provide a wide range of pumping rates with a given pump head and rotor size. Further, the pump construction permits periodic pausing or intermittent operation without loss of accuracy in average pumping rate. Accordingly, this preferred embodiment provides additional pumping rate variability without need to employ a variable speed motor. Instead, selectable on and off time, and capacity for pausing, and intermittent pumping is incorporated to ensure greater pumping rate accuracy.

The unit of FIG. 1 includes a main housing 12, a pump 14 mounted on the panel 16 of the housing, a power switch 18, an intermittent operation control knob 20, running lamps 22 and 24, and a mounting plate 26. The pump 14 includes a pump tube 30, a cam assembly 32, and a pump housing. The construction of these several parts is more readily apparent in the exploded view of FIG. 6.

In FIG. 6 the pump housing includes a pump head 34, the rear cover or pump panel 16, and front cover 36. The pump head is formed with a cylindrical bore whose arcuate inner surface (circular inner surface) serves to confine the pump tube 30 to the horseshoe shape it is shown to have in FIG. 6. The ends of the tube are assembled with end fittings 38 and 40 which interfit with the downwardly extending tube end retainer legs 42 and 44 of the pump head. The cam assembly includes three roller cams 50, 52 and 54 which are mounted 120 degrees apart for rotation relative to the cam holder. The cam holder includes front and rear spiders 56 and 58 and a spacer which interconnects the spiders.

When assembled the shaded pole driver motor 60 and the pump head 34 are bolted to opposite sides of the panel 16. The panel serves as the rear cover of the pump housing and the motor shaft 62 extends into the cylindrical recess formed by the combination of the pump head and panel. The cam assembly 32 is mounted on the motor shaft 62. The shaft extends entirely through the spacer and the two spiders 56 and 58, and the cam assembly 32 fits entirely within the cylindrical recess of head 16. The motor shaft 62 is sufficiently long to extend through the transparent front cover 36 and into a fastener 64 which serves to hold the front cover in place.

The pump tube 30 is installed so that end fitting 38 is lodged in the U-shaped recess or channel which is defined by retainer leg 42. End fitting 40 is lodged in the U-shaped recess or channel defined by retainer leg 44. The intermediate section of tube 30 lies within the cylindrical pump cavity. It is positioned over and around the cam assembly and lies between the rear cover or panel 16 and the front cover 64, as best shown in FIG. 1.

The inner wall of the pump head is circular and its axis is coincident with the axis of motor shaft 62 and cam assembly rotation. The clearance between each of the cam rollers 50, 52 and 54 is about 2.6 mm, just enough to pinch the inner and outer walls of the tube together to prevent communication between the portions of the tube lumen on either side of each roller. The tube is resilient. Its internal bias is such as to expand it to circular form in cross-section when relaxed.

In FIG. 1 the cam assembly rotates counterclockwise. Fluid to be pumped enters the tube at fitting 40 and exits at fitting 38. After one of the rollers has passed over the tube adjacent to fitting 40 and proceeds around away from the fitting, the tube is free to return to circular cross-section. In doing so, it draws or receives fluid from the inlet line at the fitting. Fluid continues to flow into the tube until it is pinched shut by the succeeding roller. Thereafter the fluid in the portion of the tube between the two rollers is forced along the length of the tube a the rollers roll over successive points along the tube. Finally, the fluid is discharged at outlet fitting 38. Because the tube expands to circular cross-section as the roller passes, the unit serves as a suction pump.

Because of the pinching and rolling and expanding, peristaltic pump tubes tend to "walk" back and forth transversely to the direction of cam motion and to tug at the inlet end and to push at the outlet end. But that does not occur in the invention. The tube is prestressed in a degree that exceeds the stresses imposed as an incident to roller operations. Pre-stressing is accomplished by twisting the tube against its renitence and holding it in twisted state. If pre-stressing exceeds the operational stresses in substantial degree then operational stresses, whether they increase or decrease the pre-stressing, will have little effect, and any movement of the tube will be greatly reduced.

The preferred pump tube is one that will lie in a flat plane when relaxed. Such a tube may be pre-stressed by twisting it about its longitudinal center line in the direction of its length with predictable results. It is preferred that the tube be manufactured so that it is curved in that flat plane in the manner depicted in FIG. 2. The curved tube has an inner radius which is a little less than its outside radius. The result is a reduced tendency to twist when installed and in use in the pump. However, the radius of the relaxed tube is greater in preferred form than the installed radius so that the inner wall is compressed in some degree when installed. In that circumstance cam action first relieves the compression and then stretches the inner wall as pinching becomes complete. The result is smaller deviation from relaxed or zero stress.

When the tube is bent to smaller radius, and to the horseshoe shape that it has when installed, an when it is twisted less than one-half turn in the direction of its length by rotating the ends in opposite directions, it bends out of the flat plane to a curved plane as shown in FIG. 5. Until the degree of twist exceeds one-half turn, the tube shape remains substantially symmetrical about the transverse midplane that extends between the tube ends. That symmetry is lost if the degree of twist exceeds one-half turn, and the advantage of pre-stressing is lost.

In this preferred embodiment the tube is installed such that the intermediate portion is bent toward the rear wall of the pump cavity. The tube end fittings may be, and in the preferred form they are, fixed to the pump head toward its forward face. As best shown in FIG. 6, the retainer legs 42 and 44 are positioned to hold the end fittings adjacent to the forward edge of the pump head. They are held there by the retainer tabs 68 and 70 of the front cover as best shown in FIG. 1.

FIGS. 3 and 4 show the bottom end and the top end, respectively, of the end fittings. Three sides are flat. The fourth side is rounded. The rear surface of the channels in the retainer legs 42 and 44 is rounded. The sides are flat and parallel. The end fittings 38 and 40 will fit into the retainer leg channels, and they will be prevented from rotating. The fitting is the key, the channels, the keyway.

In this embodiment the end fittings are arranged such that they are oriented at an angle of about seventy degrees from one another in the direction radial to the tube axis. That is best shown in FIG. 2 where the tube is shown in relaxed condition. At the time of insertion the fittings are rotated toward one another through that seventy degrees. When the fittings are inserted in the grooves of the retainer legs, the legs alone oppose the renitence of the twisted tube. The tabs 68 and 70 are not strained. No more than the fastener 64 is needed to keep the cover 36 in place.

The preferred amount of pre-biasing is from two to six degrees per centimeter of tubing length within the pump cavity. The upper limit, however, is one-half turn over the length of the tubing. The lower limit is one-tenth turn over that length.

Although I have shown and described certain specific embodiments of my invention, I am fully aware that many modifications thereof are possible. My invention, therefore, is not to be restricted except insofar as is necessitated by the prior art.

I claim:

1. For use in a peristaltic pump of the kind in which a length of tubing is disposed in a housing, the housing having an end wall and having an inner wall whose shape defines a segment of a circle, and a set of rollers rotatable about an axis which extends through the end wall, said rollers serving to compress said tubing against said side wall at successive points along said side wall, and the housing being formed with locking elements for engaging key structures at the ends of the tubing and preventing relative rotation of the tubing ends about the central axis of the tubing from a given angular orientation of said key structures:

a length of resilient peristaltic pump tubing each end of which is fitted with a respectively associated key structure fixed to the tubing such that when the tubing is relaxed the two key structures have a relative angular orientation about the center line of the tubing which differs from said given angular orientation by a substantial amount not more than one-half turn about said central axis.

2. The invention defined in claim 1 in which said tubing will lie in a substantially flat plane when relaxed.

3. The invention defined in claim 1 in which said key structures are fixed to the ends of said tubing and said relative angular displacement about the center line of the tubing is between one-tenth and one-half of a turn about the central axis of the tubing.

4. For use in a peristaltic pump housing of the kind which has a length of perstaltic tubing disposed in a cavity formed by a rear wall and side walls which side walls form a segment of a circle and against which side walls the tubing pressed by a set of pump rollers, the pump housing including locking means for holding the tubing ends against relative rotation about the central axis of the tubing, in combination:

a length of resilient tubing; and means in the form of end fittings each fixed to a respectively associated end of said length of tubing for cooperation with said locking means of the pump housing for holding said tube twisted about its axial center line such that the central region of the tubing is biased toward said rear wall of the pump when installed.

5. The invention defined in claim 4 in which said end fittings are formed as rotation preventing keys and in which the keys are displaced rotationally relative to the central axis of the tubing by an amount less than one-half turn and more than one-tenth turn.

6. A peristaltic pump comprising:

a pump body which defines a cavity having a rear wall and a side wall which side wall forms a segment of a circle;

a length of resilient tubing disposed in said body such that a central region of the tubing lies against said side wall;

means mounted for rotation in said cavity for pressing the tubing against the pump body at successive points along said side wall; and means for holding said tubing twisted about its central axis in a degree less than one-half turn and more than one-tenth turn such that a central region of the tubing is biased toward said rear wall.

7. The invention defined in claim 6 in which said means for holding said tubing comprises complementally formed lock and key structures carried on the pump body and on the ends of the length of tubing such that a lock and a key is associated with each end of said length of tubing.

8. In a peristaltic pump of the kind in which fluid is forced through a resilient tube which is squeezed at successive points along is length between an inner circular wall of a cylindrical cavity and a cam carried on a holder which is rotatable on the axis of the circular wall, the improvement which comprises fixing the ends of the resilient tube relative to the cavity wall such that the tube is held twisted about its longitudinal center line less than one-half turn and more than one-tenth turn.

9. The invention defined in claim 8 in which the cam is driven from one side of said cavity and in which said tube is twisted by a relative rotation of portions of said tube whereby the central region of the tube is biased toward said one side of said cavity.

10. The invention defined in claim 9 which further comprises a structure in which the ends of said tube are held fixed; and said structure and the ends of said tube having conformations that are complementary when said tube is so twisted and which prevent untwisting of said tube.

* * * * *